US009725987B2

(12) United States Patent
Wutherich et al.

(10) Patent No.: US 9,725,987 B2
(45) Date of Patent: Aug. 8, 2017

(54) SYSTEM AND METHOD FOR PERFORMING WELLBORE STIMULATION OPERATIONS

(75) Inventors: Kevin Wutherich, Pittsburgh, PA (US); Kirby Jon Walker, Sewickley, PA (US); Walter Sawyer, Coraopolis, PA (US); Babatunde Ajayi, Coraopolis, PA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 382 days.

(21) Appl. No.: 14/126,053

(22) PCT Filed: Jul. 11, 2012

(86) PCT No.: PCT/IB2012/053552
§ 371 (c)(1),
(2), (4) Date: Mar. 4, 2014

(87) PCT Pub. No.: WO2013/008195
PCT Pub. Date: Jan. 17, 2013

(65) Prior Publication Data

US 2014/0182844 A1 Jul. 3, 2014

Related U.S. Application Data

(60) Provisional application No. 61/572,095, filed on Jul. 11, 2011.

(51) Int. Cl.
*E21B 49/00* (2006.01)
*E21B 41/00* (2006.01)
(Continued)

(52) U.S. Cl.
CPC ..... *E21B 41/0092* (2013.01); *E21B 43/26* (2013.01); *E21B 47/0002* (2013.01);
(Continued)

(58) Field of Classification Search
CPC .... E21B 47/0002; E21B 47/06; E21B 49/006; E21B 49/008
See application file for complete search history.

(56) References Cited

U.S. PATENT DOCUMENTS 4,858,198 A * 8/1989 Weissman ..... G01V 1/50 367/31
4,936,139 A 6/1990 Zimmerman et al.
(Continued)

FOREIGN PATENT DOCUMENTS

CN 101737027 A 6/2010
RU 2055172 C1 2/1996
(Continued)

OTHER PUBLICATIONS

Wu et al., "Numberical simulation on low-permeability reservoir with abundant natural micro-fracutres", Acta Petrolei Sinica, No. 5, vol. 30, pp. 727-730, Sep. 30, 2009. (English translation of abstract only).

(Continued)

*Primary Examiner* — Giovanna C Wright
(74) *Attorney, Agent, or Firm* — Michael L. Flynn; Jody Lynn DeStefanis; Robin Nava

(57) ABSTRACT

A method of performing a stimulation operation for a subterranean formation penetrated by a wellbore is provided. The method involves collecting pressure measurements of an isolated interval of the wellbore during injection of an injection fluid therein, generating a fracture closure from the pressure measurements, generating transmissibility based on the fracture closure and a mini fall off test of the isolated interval during the injection, obtaining fracture geometry from images of the subterranean formation about the isolated interval, and generating system permeability from the transmissibility and the fracture geometry. The method may also involve deploying a wireline stimulation
(Continued)

tool into the wellbore, isolating an interval of the wellbore and injecting fluid into the interval with the wireline stimulation tool. The fracture geometry may be obtained by imaging the formation, and fracture geometry may be obtained from core sampling.

24 Claims, 8 Drawing Sheets

(51) Int. Cl.

| | |
|---|---|
| ***E21B 47/00*** | (2012.01) |
| ***E21B 43/26*** | (2006.01) |
| ***E21B 47/06*** | (2012.01) |
| ***E21B 49/02*** | (2006.01) |

(52) U.S. Cl.
CPC ..... *E21B 47/06* (2013.01); *E21B 49/00* (2013.01); *E21B 49/006* (2013.01); *E21B 49/008* (2013.01); *E21B 49/02* (2013.01)

(56) References Cited

U.S. PATENT DOCUMENTS

| | | | | |
|---|---|---|---|---|
| 5,285,683 | A * | 2/1994 | Abass | E21B 43/26 166/308.1 |
| 5,353,637 | A * | 10/1994 | Plumb | E21B 49/08 166/101 |
| 6,076,046 | A | 6/2000 | Vasudevan et al. | |
| 7,031,841 | B2 | 4/2006 | Zazovsky et al. | |
| 7,380,599 | B2 | 6/2008 | Fields et al. | |
| 7,472,748 | B2 | 1/2009 | Gdanski et al. | |
| 2001/0011590 | A1 | 8/2001 | Thomas et al. | |
| 2007/0079652 | A1 | 4/2007 | Craig | |
| 2010/0058854 | A1 | 3/2010 | Waters et al. | |
| 2012/0133367 | A1* | 5/2012 | Bittar | E21B 43/26 324/346 |

FOREIGN PATENT DOCUMENTS

| | | | |
|---|---|---|---|
| RU | 2270335 | C2 | 2/2006 |
| WO | 2007086771 | A1 | 8/2007 |
| WO | 2009035884 | A1 | 3/2009 |
| WO | 2009079234 | A2 | 6/2009 |
| WO | 2009096805 | A1 | 8/2009 |

OTHER PUBLICATIONS

Barree, et al., "Determination of Pressure Dependent Leakoff and Its Effect on Fracture Geometry", SPE 36424—SPE Annual Technical Conference and Exhibition, Denver, Colorado, Oct. 6-9, 1996, pp. 1-10.

Economides, et al., "Chapter 9: Fracture Evaluation Using Pressure Diagnostics", Reservoir Stimulation, John Wiley & Sons, Third Edition, 2000, pp. 56-58.

Wutherich, et al., "Insitu Analysis of Minimum Stress, Pore Pressure and Permeability in Shales", SPE 149429—SPE Eastern Regional Meeting, Columbus, Ohio, Aug. 17-19, 2011, pp. 1-7.

K.G. Nolte, "Background for After-Closure Analysis of Fracture Calibration Tests," SPE 39407, Unsolicited companion paper to SPE 38676 (Jul. 1997).

J. Desroches et al., "Applications of Wireline Stress Measurements," SPE 58086, SPE Reservoir Eval. & Eng., vol. 2, No. 5 (Oct. 1999).

B. B. Yeager et al., "Injection/Fall-off Testing in the Marcellus Shale: Using Reservoir Knowledge to Improve Operational Efficiency," SPE 139067, SPE Eastern Regional Meeting, Morgantown WV USA (Oct. 12-14, 2010).

R.D. Barree et al., "Holistic Fracture Diagnostics: Consistent Interpretation of Prefrac Injection Tests Using Multiple Analysis Methods," SPE 107877, SPE Production & Operations, vol. 24, No. 3 (Aug. 2009).

S. N. Gulrajani et al., "Reservoir Stimulation" in: Gulrajani, S.N., Fracture Evaluation Using Pressure Diagnostics (England, John Wiley & Sons Ltd., 2000) vol. 3, Ch. 9, pp. 56-58.

K.G. Nolte et al., "After-Closure Analysis of Fracture Calibration Tests," SPE 38676, 1997 SPE Annual Technical Conference and Exhibition, San Antonio TX USA (Oct. 5-8, 1997).

M.J. Mayerhofer et al., "Permeability Estimation From Fracture Calibration Treatments," SPE 26039, Western Regional Meeting, Anchorage AK USA (May 26-28, 1993).

G.R. Talley et al., "Field Application of After-Closure Analysis of Fracture Calibration Tests," SPE 52220, 1999 SPE Mid-Continent Operations Symposium, Oklahoma City OK USA (Mar. 28-31, 1999).

David P. Craig et al., "Adapting High Permeability Leakoff Analysis to Low Permeability Sands for Estimating Reservoir Engineering Parameters," SPE 60291, 2000 SPE Rocky Mountain Regional/Low Permeability Reservoirs Symposium, Denver CO USA (Mar. 12-15, 2000).

T.A. Harting et al., "Application of Mini-Falloff Test to Determine Reservoir Parameters and Optimize Fracture Designs in a Tight Gas Field," SPE 90455, SPE Annual Technical Conference and Exhibition, Houston TX USA (Sep. 26-29, 2004).

B. Sinha et al., "Near-Wellbore Alteration and Formation Stress Parameters Using Borehole Sonic Data," SPE 95841, 2006 SPE Annual Technical Conference and Exhibition, Dallas, Texas, USA (Oct. 9-12, 2005).

Y. Yang et al, "A Novel Method to Calculate the Reservoir Pressure of Tight Sand Using the Hydraulic Fracturing Information in the Denver-Julesburg Basin," SPE 111089, 2007 SPE Eastern Regional Meeting, Lexington KY USA (Oct. 17-19, 2007).

R.L. Ceccarelli et al., "New Methodology of Mini-Fall-Off Test to Optimize Hydraulic Fracturing in Unconventional Reservoirs," SPE 122326, 2009 SPE European Formation Damage Conference, Scheveningen, NL (May 27-29, 2009).

M. Ramurthy et al., "Effects of High Process-Zone Stress in Shale Stimulation Treatments," SPE 123581, 2009 SPE Rocky Mountain Petroleum Technology Conference, Denver CO USA (Apr. 14-16, 2009).

H. Ramakrishnan et al., "Application of Downhole Injection Stress Testing in the Barnett Shale Formation," SPE 124147, 2009 SPE Annual Technical Conference and Exhibition, New Orleans LA USA (Oct. 4-7, 2009).

B. Nojabaei et al., "Establishing Key Reservoir Parameters with Diagnostic Fracture Injection Testing," SPE 153979, American Unconventional Resources Conference, Pittsburgh PA USA (Jun. 5-7, 2012).

B.C. Craft and M.F. Hawkins, "Single-Phase Fluid Flow in Reservoirs." in: Applied Petroleum Reservoir Engineering (New Jersey, Prentice Hall, 1991) Ch. 7, pp. 223-226.

* cited by examiner

FIG. 1.1
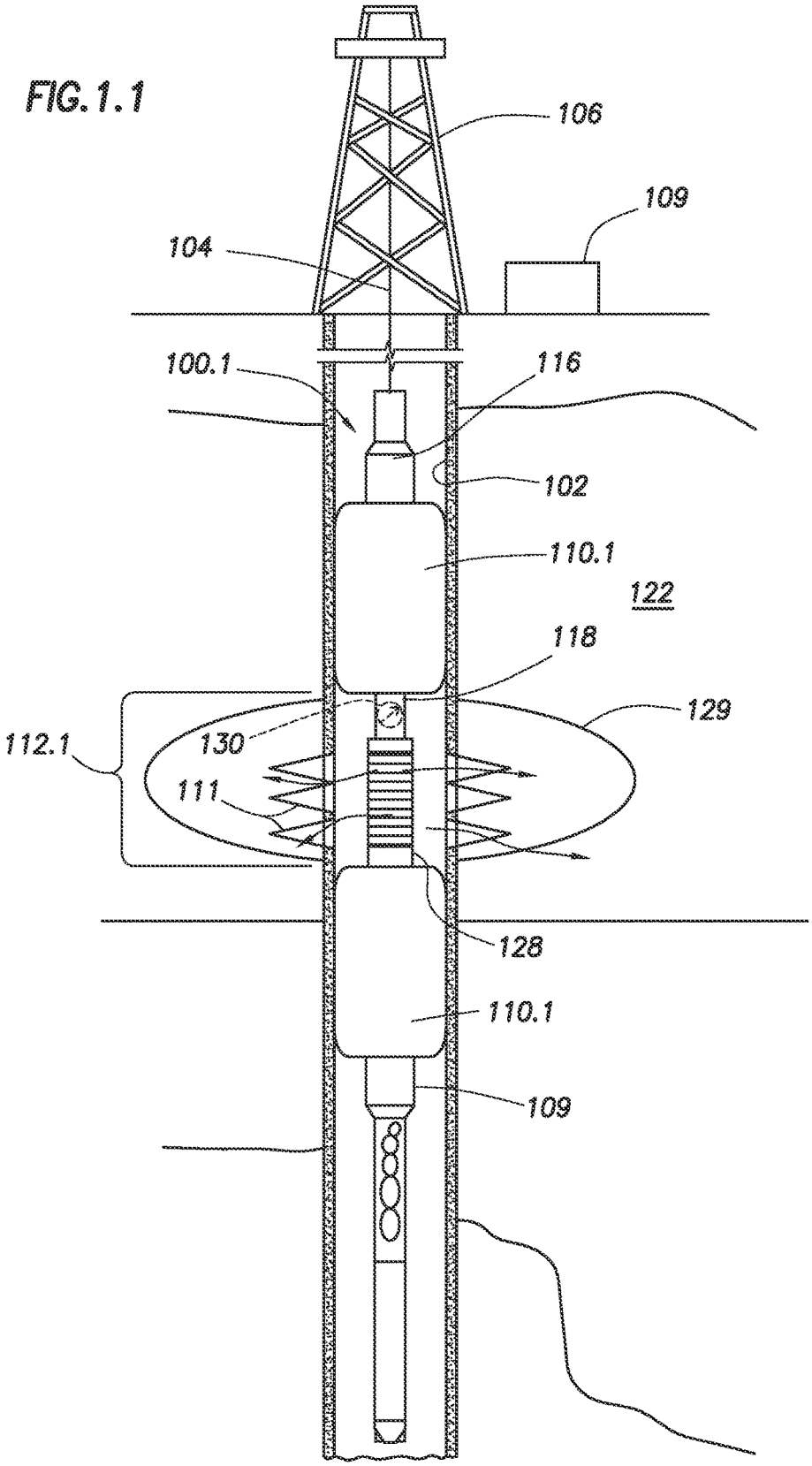

FIG. 1.2
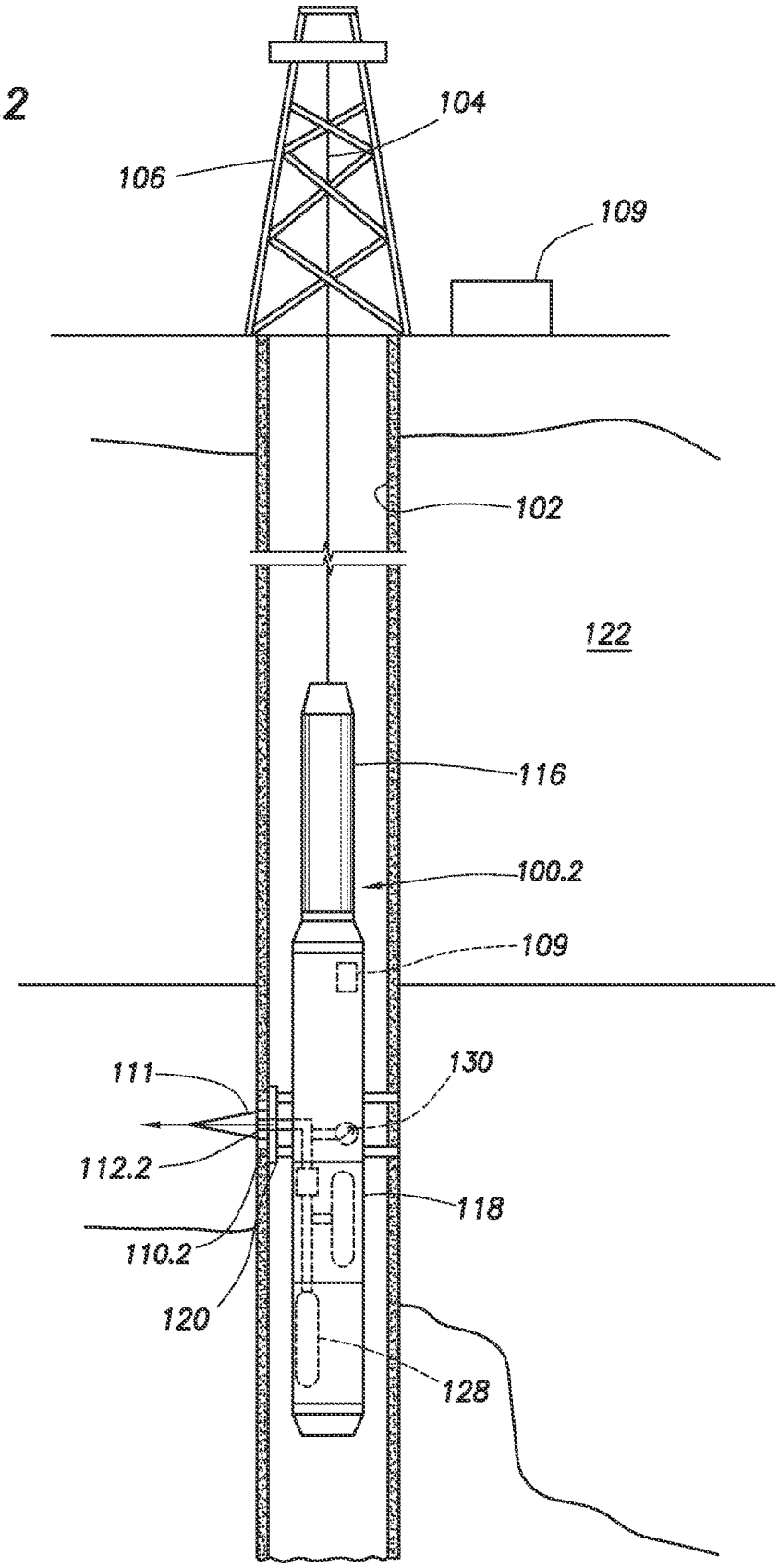

FIG. 1.3
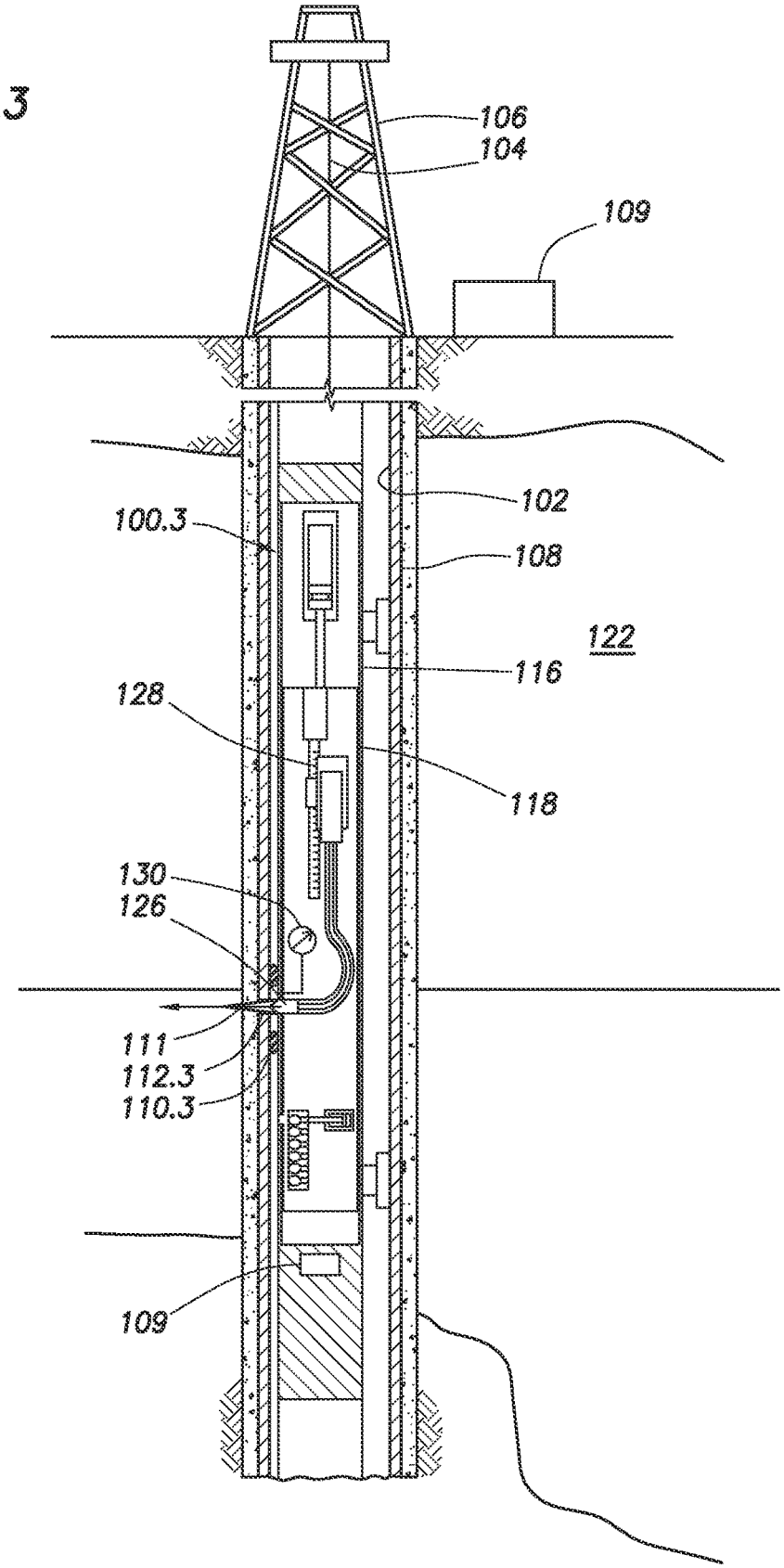

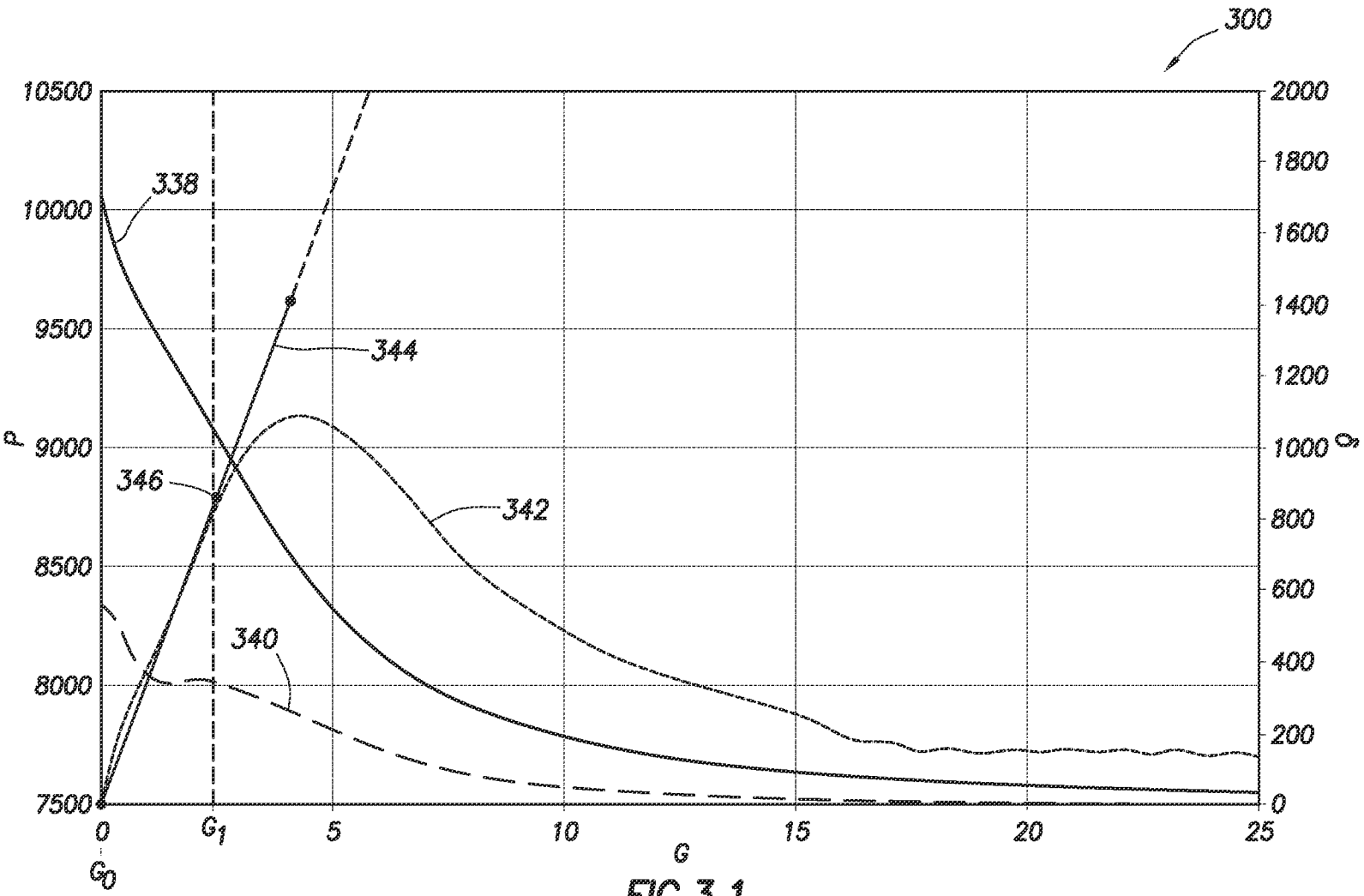
FIG.3.1

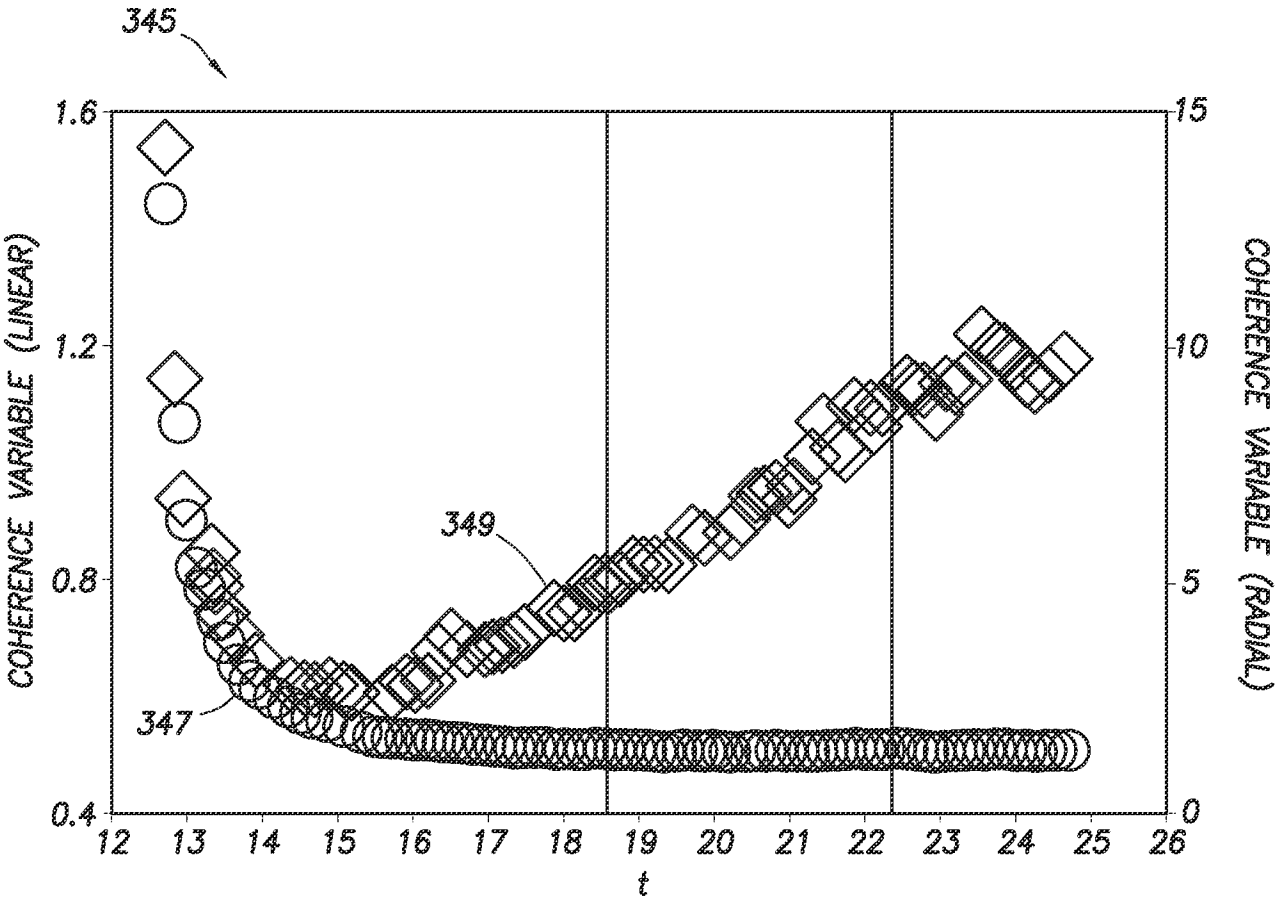
FIG.3.2

SYSTEM AND METHOD FOR PERFORMING WELLBORE STIMULATION OPERATIONS

BACKGROUND

The present disclosure relates to techniques for performing oilfield operations. More particularly, the present disclosure relates to techniques for performing wellbore stimulation operations, such as perforating, injecting, treating, fracturing and/or characterizing subterranean formations.

Oilfield operations may be performed to locate and gather valuable downhole fluids, such as hydrocarbons. Oilfield operations may include, for example, surveying, drilling, downhole evaluation, completion, production, stimulation, and oilfield analysis. Surveying may involve seismic surveying using, for example, a seismic truck to send and receive downhole signals. Drilling may involve advancing a downhole tool into the earth to form a wellbore. Downhole evaluation may involve deploying a downhole tool into the wellbore to take downhole measurements and/or to retrieve downhole samples. Completion may involve cementing and casing a wellbore in preparation for production. Production may involve deploying production tubing into the wellbore for transporting fluids from a reservoir to the surface.

In some cases, stimulation operations may be performed to facilitate production of fluids from subsurface formations. Such stimulations may be performed by perforating the wall of the wellbore to create a flow path to reservoirs surrounding the wellbore. Natural fracture networks extending through the formation also provide pathways for the flow of fluid. Man-made fractures may be created and/or natural fractures expanded to increase flow paths by injecting treatment into the formation surrounding the wellbore.

Certain downhole parameters may affect stimulation operations. Oilfield analysis may be performed using such downhole parameters to characterize and understand downhole conditions. In some cases, oilfield analysis may involve deploying downhole tools into the wellbore to measure downhole parameters, such as temperature and pressure, or to perform various downhole tests, such as minifracs, microfracs and Diagnostic Fracture Injection Tests (DFIT). The resulting information may be analyzed to characterize downhole conditions which may affect stimulation and/or production. Examples of downhole analysis are provided in U.S. Pat. No. 6,076,046; K. G. Nolte, "Background for After-Closure Analysis of Fracture Calibration Tests", (SPE 39407), Unsolicited companion paper to SPE 38676, July 1997 (referred to herein as "SPE 39407"); Jean Desroches et al., "Applications of Wireline Stress Measurements" (SPE 58086), SPE ATCE, New Orleans, La., USA, 27-30 Sep. 1999 (referred to herein as "SPE 58086"); Bryce B. Yeager et al., "Injection/Fall-off Testing in the Marcellus Shale: Using Reservoir Knowledge to Improve Operational Efficiency", (SPE 139067) SPE Eastern Regional Meeting, Morgantown, W.Va., USA, 12-14 Oct. 2010 (referred to herein as "SPE 139067"); and R. D. Baree et al., "Holistic Fracture Diagnostics: Consistent Interpretation of Prefrac Injection Tests Using Multiple Analysis Methods,"(SPE 107877) SPE Vol. 24, No. 3, August 2009 (referred to herein as "SPE 107877"), the entire contents of which are hereby incorporated by reference. Some rock formations, such as shale, may pose difficulties in performing certain downhole measurements and/or characterizations.

SUMMARY

In at least one aspect, the present disclosure relates to a method of performing a stimulation operation for a subterranean formation penetrated by a wellbore. The method involves collecting pressure measurements of an isolated interval of the wellbore during injection of an injection fluid therein, generating a fracture closure from the pressure measurements, generating transmissibility based on the fracture closure and a mini fall off test of the isolated interval during the injection, obtaining fracture geometry from images of the subterranean formation about the isolated interval, and generating system permeability from the transmissibility and the fracture geometry. The method may also involve perforating the subterranean formation, deploying a wireline stimulation tool into the wellbore, isolating an interval of the wellbore with at least one packer of the wireline stimulation tool, injecting fluid into the interval of the wellbore and measuring pressure in the interval. The isolated interval may be a small volume of from about 100 to about 400 mL. In some cases, the method may involve imaging the subterranean formation, obtaining core samples and performing sonic logging.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of the system and method for characterizing wellbore stresses are described with reference to the following figures. The same numbers are used throughout the figures to reference like features and components.

FIGS. 1.1-1.3 are schematic diagrams partially in cross-section and illustrating a wellsite with various wireline stimulation tools in which embodiments of methods may be implemented;

FIG. 3.1 is a graph illustrating pressure and derivative versus time;

FIG. 3.2 is a graph illustrating coherence variables versus time;

DETAILED DESCRIPTION

Figure 2:
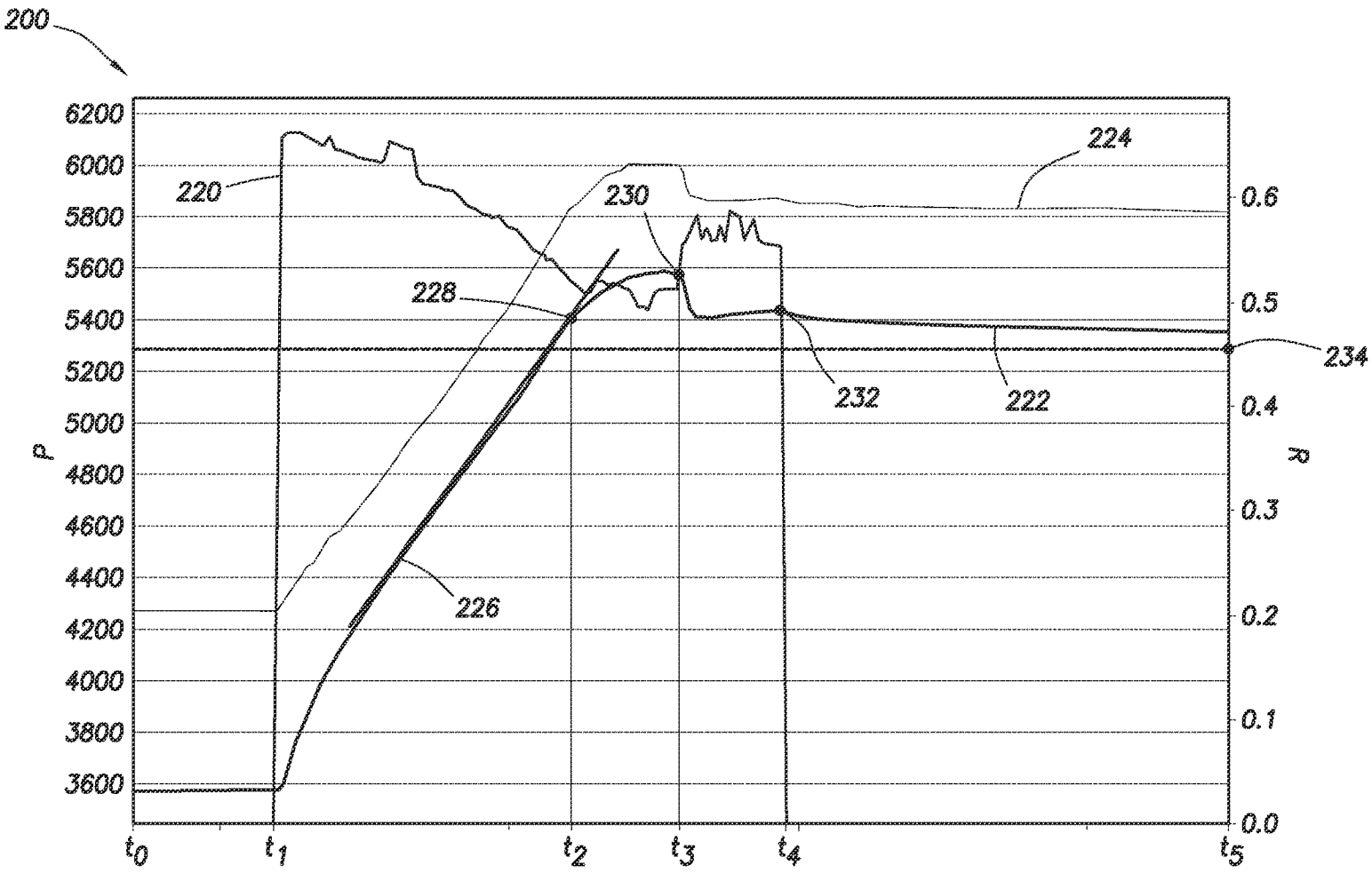
FIG. 2 is a graph illustrating pressure and pump rate versus time.

The description that follows includes exemplary systems, apparatuses, methods, and instruction sequences that embody techniques of the subject matter herein. However, it is understood that the described embodiments may be practiced without these specific details.

The present disclosure relates to techniques for performing stimulation operations using a wireline stimulation tool. The wireline stimulation tool may be deployed downhole to isolate a small interval of the wellbore and inject fluids into the surrounding formation. During injection, the wireline stimulation tool may also be used to take downhole measurements, such as temperature and pressure, and to perform stimulation tests, such as mini fall off tests and stress tests. The information gathered may be used to determine various downhole parameters, such as fracture dimensions, and to characterize the wellbore and surrounding formation.

Wireline Stimulation

FIGS. 1.1-1.3 depict various wireline stimulation tools 100.1, 100.2, 100.3 respectively, usable in performing downhole stimulation operations, such as fracture, injection, measurement and/or testing operations. Each of these wireline stimulation tools 100.1, 100.2, 100.3 is deployed in a wellbore 102 via a wireline 104 suspended from a rig 106. The wellbore 102 may be an open hole as shown in FIGS. 1.1 and 1.2, or have casing 108 cemented in place to form a cased hole as shown in FIG. 1.3. A controller 109 may be provided at a surface location and/or in the wireline stimulation tools 100.1, 100.2, 100.3. Other devices, such as communication, sampling, and other downhole tools, may also be provided.

While a land based rig with a wireline tool is depicted in each of these figures, certain techniques described herein may be used in any rig (e.g., land or water based) and with any downhole tool capable of performing the stimulation, measurement and/or testing operations. In some cases, multiple downhole tools may be used to perform various portions of the operations. For example, a separate perforation tool may be used. In another example, multiple tools may be used to perform downhole measurement and/or testing.

Each of the wireline stimulation tools 100.1, 100.2, 100.3 has an isolation means for isolating a portion of the wellbore 102. The isolation means may be a conventional packer or packers 110.1, 110.2, 110.3 made of an elastomeric material for sealing engagement with a wall of the wellbore (or casing if present). The packer(s) 110.1, 110.2, 110.3 define an interval 112.1, 112.2, 112.3 fluidly isolated from the remainder of the wellbore 102 to define a pressure sealed region with a reduced volume in which certain tests may be performed.

The wireline stimulation tool 100.1 of FIG. 1.1 has dual packers 110.1 expandable about the wireline stimulation tool for isolating the interval 112.1 therebetween. The wireline stimulation tool 100.1 is also provided with other devices, such as a pumpout module 116 for pumping fluid and a flow control module 118 for selectively diverting fluid through the wireline stimulation tool 100.1. The wireline stimulation tool 100.1 may be a conventional wireline tool, such as the Modular Dynamics Tester (MDT™) with dual packers commercially available from Schlumberger Technology Corporation (see: www.slb.com). Examples of downhole measurements, such as wireline stress measurements based on micro hydraulic fracturing using a wireline conveyed MDT configured with dual packers, a pump out module and a flow control module, are outlined in SPE 58086, previously incorporated herein.

Alternate wireline stimulation tools that may be used are shown in FIGS. 1.2 and 1.3. The wireline stimulation tool 100.2 has a probe 120 with the packer 110.2 thereon positionable for engagement with a wall of the wellbore 102 and defining the interval 112.2 therein. The wireline stimulation tool 100.1 may be a conventional wireline tool, such as the MDT™ with probe commercially available from Schlumberger Technology Corporation (see:www.slb.com).

In some cases, such as where casing is present, it may be necessary to have perforation devices to perforate the formation 122 and facilitate production and/or injection. The wireline stimulation tool 100.3 (or a separate tool) may have devices for creating the perforation 111, such as the extendable bit 126, as shown in FIG. 1.3. A packer 110.3 is provided for defining the interval 112.3 about the perforation 111. The wireline stimulation tool 100.3 may be a wireline tool with drilling capabilities, such as the Cased Hole Dynamics Tester (CHDT™) commercially available from Schlumberger Technology Corporation (see:www.slb.com).

The wireline stimulation tools 100.1, 100.2, 100.3 may be provided with a fluid source 128 for injection of fluid into the interval isolated by the packer(s) 110.1, 110.2, 110.3. The fluid may be injected into the intervals 112.1, 112.2, 112.3 and pass into the perforations 111 and fractures 129 in the surrounding formation 122.

The wireline stimulation tools 100.1, 100.2, 100.3 or other downhole measurement devices may be provided for measuring various downhole parameters before, during or after the stimulation operations. The wireline stimulation tools 100.1, 100.2, 100.3 may be provided, for example, with one or more gauges 130 for measuring downhole parameters, such as pressure, temperature, and flow rate. The wireline stimulation tool may also be provided with devices for imaging, coring, and for performing other tests as needed.

In operation, the wireline stimulation tools 100.1, 100.2, 110.3 may be used to perform various tests. Testing can take from about 20 minutes to about 1.5 hours or up to 10 or more hours, depending on, for example, the number of injection cycles that are performed, the permeability of the reservoir and the amount of fluid that is injected. For shale applications, the test time may be, for example, from about 1.5 to about 4 hours. Once data is acquired, packers may be deflated or disengaged and the wireline stimulation tool moved to another test interval.

Pressure Measurement

FIG. 2 is a graph 200 showing a pumping sequence for a test performed by a wireline stimulation tool, such as those depicted in FIGS. 1.1-1.3. The graph 200 depicts pressure P (left y-axis) and pump rate R (right y-axis) versus time t (x-axis) during a testing operation. Line 220 depicts the pump rate of the pumpout module during the testing operation. Line 222 depicts pressure measured in the interval (e.g., between the packers in FIG. 1.1) by a pressure gauge (e.g., a quartz gauge). Line 224 depicts pressure measured by another pressure gauge, such as a sensor in the packer(s).

At time zero ($t_0$), once the wireline stimulation tool has been properly positioned, an interval to be tested is isolated by inflating or setting the packers to form a packer seal as shown in FIGS. 1.1-1.3. Once set and sealed with the wellbore, treatment fluids may be injected into the interval under pressure and forced into the surrounding formation.

At time $t_1$, the pumpout module is turned on and the pumps begin to pump. Fluid is injected into the interval until pressure in the interval starts to rise. A subsequent pressure decline may then be observed to check the quality of the packer seal. The packer(s) may be further pressurized or reset if the seal is not satisfactory.

As more fluid is pumped into the interval, the pressure increases as indicated by lines 222 and 224 and the pump rate slows as indicated by line 220. The slope of an initial portion of line 222 during this initial phase is depicted by line 226. Fluid may be injected into the interval again and up to the initiation of a tensile fracture to perform a hydraulic fracturing cycle. Line 222 deviates from line 226 at injection point 228 at time $t_2$. The injection point 228 is the point at which the pressure in the interval has increased sufficiently to press into the formation and increase the fractures in the surrounding formation.

After the injection point 228, line 222 flattens until breakdown occurs at time $t_3$ and point 230. The breakdown point 230 is considered the point at which minimum stress is overcome, the rock fails and fracture occurs. At a certain pressure, the fluid will eventually break the rock and extend the fractures to receive additional fluid. Fracture initiation is recognizable either by a breakdown or by a pressure plateau.

The fracture may be extended by injecting a certain volume of fluid before the pump is stopped (shut in). Once the pumps have stopped, this point 232 is referred to as the instantaneous shut in pressure (ISIP). The line 222 continues to flatten until shut in occurs at ISIP point 232 at time $t_4$. FIG. 2 indicates when a fracture begins to initiate at point 228, which is indicated by a change in pressure slope of line 222, when breakdown finally occurs at point 230, and finally at the instant ISIP point 232, which was recorded when pumping stopped.

At time $t_4$, the pumps are shut off and the pump rate drops to zero. The pressure measured by the gauges continues to read a 'fall off' pressure until a closure point 234 is reached at time $t_5$. Line 234 shows the closure pressure measured at 5282 psi (371.45 Kg/cm). To determine the volume injected into the formation, it may be assumed that fluid enters the fracture as long as the fracture is open. Thus, by taking the fluid pumped from the time closure pressure is exceeded at time $t_5$ and the time of shut in at $t_4$, an estimate of total injected fluid can be determined A series of such injection/falloff cycles may follow to reopen, further propagate, and close the fracture to both check that the test is repeatable and possibly change the injection parameters (flow rate and injected volume). A stress test, such as the stress test of FIG. 3, may involve any number of cycles, such as from about two to about five such cycles.

While closure point 234 in FIG. 2 provides a measure of closure, closure may also be determined by other methods. For example, closure may be obtained using a square root of shut in time wherein closure is determined as the pressure at which the pressure decline deviates from a linear dependence on the square root of shutin time. In some cases, such as with shale formations or other applications where multiple or unclear closure points are present, a G-function derivative analysis may be used to determine closure. The characteristic shape of the superposition derivative of the G-function may help to determine whether the primary fracture has closed or not.

Fracture Closure

FIG. 3.1 is a graph 300 depicting a G Function Superposition Derivative Analysis. This analysis may be based on, for example, the pressure test depicted in FIG. 2. This graph 300 depicts a stress test which plots pressure P (left y-axis) and derivative δ (right y-axis) versus time G (x-axis). Line 338 depicts pressure versus time during fall off. Line 340 shows a derivative dP/dG versus time and line 342 depicts a superposition derivative GdP/dG versus time. G Function analysis may be performed using, for example, the techniques described in SPE 107877, previously incorporated herein.

A slope line 344 is drawn along an initial linear portion of line 342 extending from $G_0$ using a best fit analysis of the slope of the incline. The deviation point 346 of the line 342 from the slope line 344 is defined as the fracture closure point 346. The fracture closure point 346 may also be confirmed by determining the point at which the derivative line 340 begins to drop off at time $G_1$.

Using this stress test procedure, fracture closure pressure may be determined in cases, for example, with multiple points within a single wellbore in a shale well. These points may include intervals both within the primary producing target as well as the rock which may be a barrier to fracture growth. Further, a formation imaging tool may be run to identify preexisting fractures and defects in the borehole wall. Once detected, these features may then be avoided to ensure isolation of the interval being tested, for example by avoiding fluid flow around the packer(s).

Transmissibility

An after-closure analysis may be performed using the same stress test injection shown in FIG. 2 and using the closure pressure determined in 3.1 to determine transmissibility. The after-closure analysis may use the packer injection technique in unconventional wellbores, such as shales, where multiple values of in situ stress within the well may be detected. With sufficient shut in time, a pseudo radial flow regime may be reached that allows for the use of after-closure analysis using, for example, the techniques as outlined in Gulrajani and Nolte, "Reservoir Stimulation", vol. 3, ch. 9, pp. 56-58 (2000), the entire contents of which is hereby incorporated in its entirety.

Using an after-closure analysis involving pseudo-radial flow, a late-time pressure decline evolves into pseudo-radial flow allowing transmissibility to be determined using a modified Horner or mini fall off post closure analysis as shown in FIG. 3.2. FIG. 3.2 shows a graph 345 depicting a flow regime identification (FLID) plot that may be used to identify or verify the presence of a particular (linear or radial) flow regime. This FLID plot depicts a linear coherence variable (left y-axis) and a radial coherence variable (right y-axis) versus time t (x-axis). Points 347 define a curve depicting linear flow and points 349 define a curve depicting radial flow generated from the pressure graph of FIG. 2 using conventional techniques.

The points 347 and 349 define a common vertical portion adjacent the left y-axis of the plot. An average intercept of each point in this vertical portion may be calculated and used as a reasonable estimate of reservoir pressure. The slope of the curves, in conjunction with the injection volume and the pump time (closure time to be used if the formation is fractured), may be used to determine transmissibility.

This FLID plot presents normalized pressure intercept-slope ratio versus time data, such that a slope (derivative) with respect to a dimensionless time function ("FLID variable") is generated. This plot may be generated by an evaluation of the linear-radial intercepts and slopes of each piece-wise segment of the pressure response using equation (1) below, and plotting their respective ratios. A constancy in this ratio for either a linear or radial case may indicate a well-defined linear or radial flow period. Techniques for generating an FLID plot and related analysis are provided, for example, in U.S. Pat. No. 6,076,046 previously incorporated herein.

After-closure radial-flow is a function of the injected volume, reservoir pressure p, formation transmissibility, and closure time. Their relationship is provided in the following equations using the radial-flow time function, $F_R$:

$$p(t)-pr=m_r*F_R(t,\ tc) \tag{1}$$

where $t_c$ is the time to closure with time zero t set as the beginning of pumping, pr is the initial reservoir pressure, $m_r$ is functionally equivalent to the Horner slope for conventional testing; and, $$F_R(t,\ t_c)=\frac{1}{4}\ln\left(1+\frac{xt_c}{t-t_c}\right), \tag{2}$$

$$x=\frac{16}{\pi^2}$$

Thus, a Cartesian plot of pressure versus the radial-flow time function yields reservoir pressure from the y-intercept and the slope ($m_r$) permits determination of transmissibility $$\frac{kh}{\mu} = 251{,}000\left(\frac{V_i}{m_r t_c}\right) \tag{3}$$

where k is system permeability in milidarcy (mD), h is fracture height in feet (ft), μ is viscosity in centipoise (cp), $t_c$ in minutes and $V_i$ is injected volume (bbl) (note, all other equations are either dimensionless or in consistent units).

Packer injection for mini falloff allows for small volumes to be injected, and thus isolating the induced fracture height growth to an interval that is measureable within the near wellbore, and thus allows for the estimation of fracture height (h) to determine system permability (k) from equation (3). For example, in cases involving the use of post closure analysis techniques in horizontal wellbores, as well as in cases involving large volumes of fluids are injected, there may be no direct way to measure the fracture height, as the fracture extends beyond the measureable wellbore region. In addition, pinch points may potentially isolate individual reservoir sections and the height of investigation (h) which may affect a determination of permeability from the transmissibility.

Fracture Imaging

The fracture height (h) used in Equation 3 may be determined by various methods. In order to address uncertainties that may be present, a smaller injection volume may be used (e.g., an interval between dual packers in an open hole environment as in FIG. 1.1). Small injection volumes of from about 100 to about 400 ml may be injected. Also, the resulting fracture may be contained to the area between the packers. This limited volume and isolation may be used, for example, to isolate the fracture to a single section of reservoir.

Figure 4:
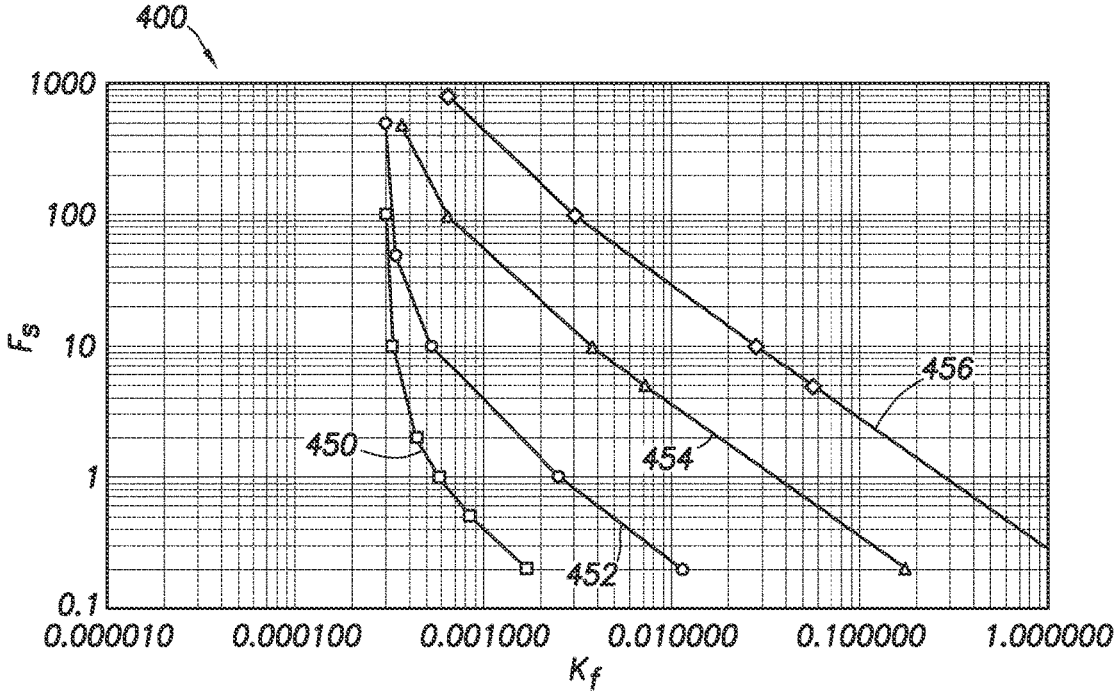
FIG. 4 is a graph illustrating system permeability versus fracture spacing.

As a first estimate of fracture height, the distance between the two packers may be used. Since the fracture height may not be the same as the packer distance, the fracture height may also be verified using a formation imaging tool, such as a Formation Micro-Imager (FMI™). The FMI may be deployed into the wellbore to perform images of the formation and fractures therein. In some cases, the downhole stimulation tool may be provided with imaging capabilities therein. The resulting fracture geometry may be used for further analysis. For example, the permeability is proportional to the fracture height. Fractures may also be characterized as shown in FIG. 4. Additional methods to determine fracture height may include the use of tracing materials such as radioactive tracers that are injected into the induced fracture system, and then imaged using tools such as a gamma ray log.

The next variable which needs to be obtained in Equation (3) is the volume of fluid injected ($v_i$). In the configuration outlined here, the volume between the packers may be from about 10 to about 12 L with volume injected of from about 100 to about 400 mL. In some cases a determination of actual injected volume into the fracture may be difficult. During the long period of time preceding fracture closure, fluid may still enter the fracture from the area between the packer(s). Thus, it may be assumed that the total injected volume of fluid equals the amount of fluid injected during the time pumping pressure first reaches the closure pressure (as calculated previously) to the time that the injection stops.

System Permeability

Using the technique outlined above, total system permeability may be established, and the fracture sets characterized. If matrix permeability is also known (i.e. through core testing), a correlation may be made in order to begin characterizing the natural fracture sets. For laminar flow through a slot, the intrinsic permeability is given by:

$$k_f = 84.2 w_f^2 \tag{4}$$

where $w_f$ is the aperture or fracture width in microns (1 micron=$1\times10^{-6}$ m) and $k_f$ is the intrinsic permeability in mD as described, for example, Craft & Hawkins, SINGLE PHASE FLUID FLOW IN RESERVOIRS, ch. 7, p. 226, Equation 7.18 ($2^{nd}$ ed. 1991).

The total system, or bulk permeability of a fractured media with fractures of width $w_f$ uniformly spaced $F_s$ feet apart in a low permeability matrix of permeability $k_m$ is given by:

$$\bar{k}_f = \frac{k_f w_f + k_m F_s}{w_f + F_s} \tag{5}$$

Equation (5) may be derived using the relationship for Darcy flow through parallel beds as where $F_s >> w_f$ equation 5 becomes:

$$k_f \approx (k_f w_f)/F_s + k_m \tag{6}$$

Figure 5:
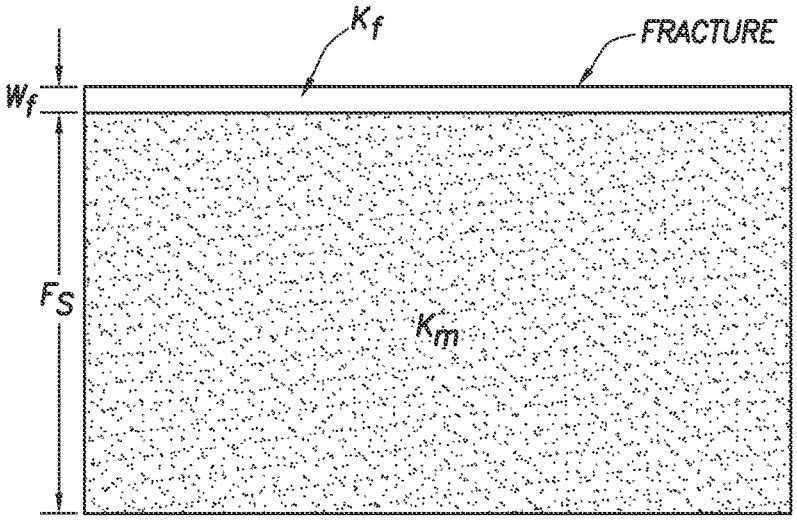
FIG. 5 is a schematic diagram illustrating a fracture of a subterranean formation.

Equation (6) is schematically depicted by the fracture diagram of FIG. 5. As shown in FIG. 5, the fracture has a fracture width $w_f$ and a fracture permeability $k_f$ for a total permeability km over a fracture spacing $F_s$. In Equation (6), $w_f$ and $F_s$ must be in the same units. With $w_f$ in microns and $F_s$ in feet, Equation (6) becomes:

$$k_f = 3.2808\times10^{-6} k_f (w_f/F_s) + k_m \tag{7}$$

By combining Equations 4 and 7, the following relationship between bulk permeability and fracture spacing for any given aperture width $w_f$ may be obtained.

$$k_f = 2.76\times10^{-4} (w_f^3/F_s) + k_m \tag{8}$$

Figure 6:
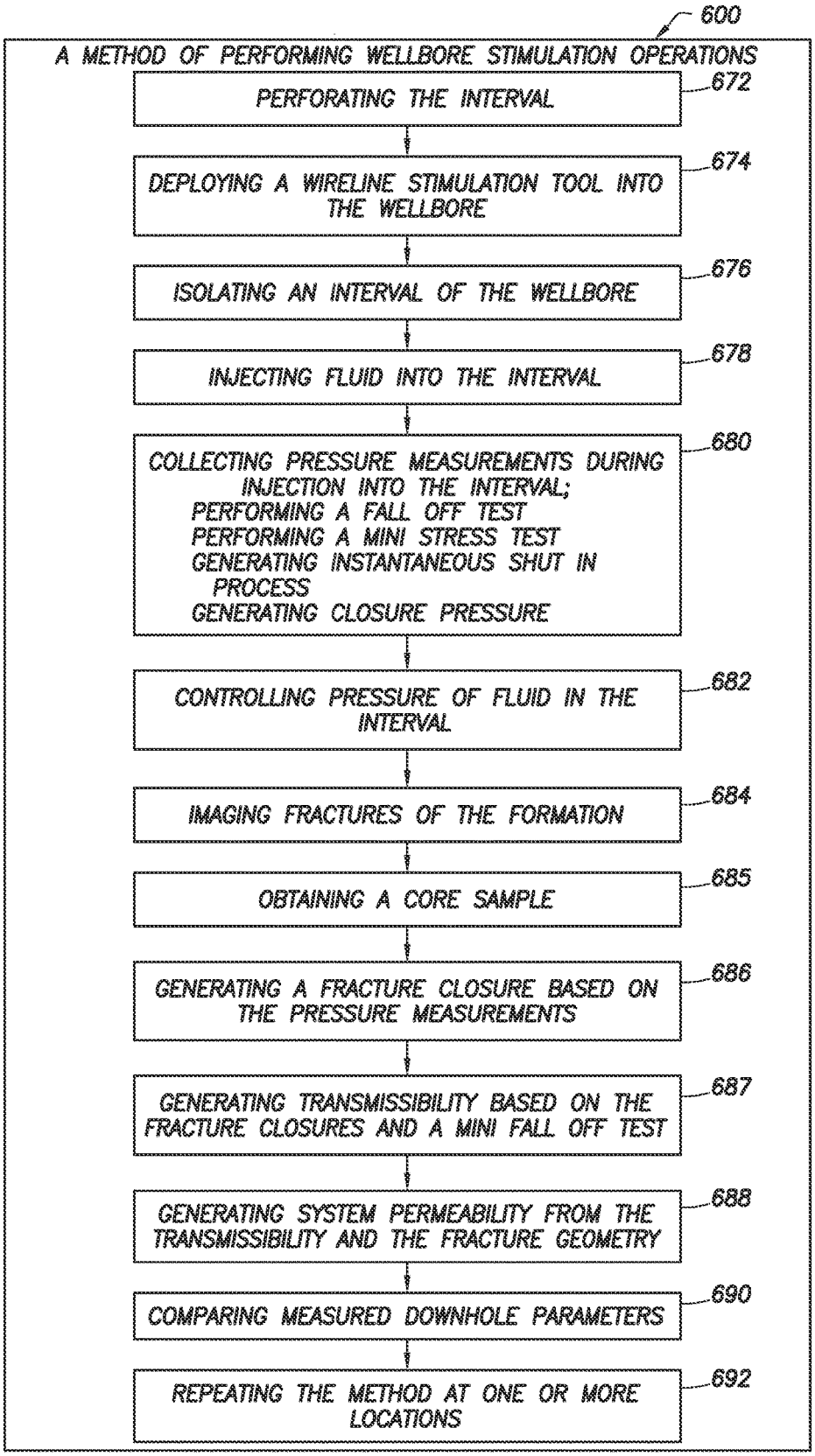
FIG. 6 is a flow chart depicting a method for performing a wellbore stimulation operation.

Using Equation 8, and setting $k_m$ as the measured core permeability, graphical representations of how fracture width and spacing may affect the system permeability as shown in FIG. 6 may be created (e.g., for a 300 nD core sample). If total system permeability is obtained using the mini falloff technique described herein, and fracture spacing is known (through methods such as micro image logs), the effective flowing width of those fractures may be determined. This creates a way to characterize the fracture sets within a reservoir, and provides another technique for production modeling. Fracture spacing, fracture width, fracture height and other fracture dimensions may be determined and used with the methods herein.

FIG. 4 is a graph 400 of fracture characterization for matrix permeability. The graph 400 depicts fracture spacing $F_s$ (y-axis) versus system permeability $K_f$ (x-axis) at the given matrix permeability of 300 nano-Darcy (nD). Lines 450, 452, 454 and 456 depict fracture spacing versus system permeability at various fracture widths of 1, 2, 5 and 10 microns, respectively. Fracture width may be determined, for example, from fracture measurements taken using the FMI™ tool, or based on estimates. As demonstrated by this graph, the system permeability may be determined based on the known (or estimated) fracture width and based on the transmissibility.

Matrix permeability may be determined from core testing using conventional methods. From the matrix permeability and the system permeability, fracture dimensions, such as fracture spacing, may be derived.

Porosity and permeability may be determined for in situ stresses and fracture characterization. The wireline stimulation tool and mini-fall off analysis may be used to obtain these same values in a variety of downhole conditions, such as in shale gas reservoir across multiple depths. The reduced interval configuration of the wireline stimulation tool may be used to define the fracture height and estimate the total volume injected into the fracture in estimating permeability. Small injection volumes may reduce the time required to reach pseudo-radial flow compared to larger pump-ins associated with mini-fracture tests. The time saved may be used to provide for additional measurements at one or more points in the wellbore during a given operation.

With the wireline stimulation tool, a measure of fracture height as well as volume injected into the zone of interest may be possible. This may allow for a determination of permeability using the mini-falloff test. However, unlike core testing, the permeability determined is a total system permeability, or an average permeability throughout the radius of investigation, and not just at a single sample point. The total system permeability obtained using the techniques outlined herein may be combined with matrix permeability gathered from core testing. This may mean that any secondary porosity, such as natural fracturing may be taken into account, which may lead to some additional possibilities for analysis. Thus, the natural fracture sets contained within the shale reservoir may also be characterized.

The information generated by the techniques herein may be used to further optimize completion strategies for horizontal wells. Modeling well spacing, hydraulic fracture design, possible production interference and other wellbore parameters may be performed based on this information.

Guidelines

Conventional tests describe applications for conventional reservoir types, but may be adapted for certain downhole conditions, such as ultra low permeability shales. For example, conventional leak off tests may not be required where the low permeability encourages the leak off to formation to be minimal. Also, to minimize the amount of fluid that is forced to leak off into the surrounding formation, which may result in lower times to closure, injected volume may be reduced to less than about 500 cc. The number of tests may be adjusted to the conditions. For example, where time is limited, about 1 to 2 tests may be performed at each interval in cases where long times are needed to obtain closure, which can be from about 30 min to over about 3 hours per individual station.

At least some of the testing, such as those involving shale reservoirs where fluid leakoff is low, may be performed using guidelines outlined by SPE 58086, previously incorporated herein by reference. At least some testing may also be used to determine parameters, such as pore pressure and permeability. For example, testing may be used to maximize the possibility of obtaining pseudo radial flow within a reasonable amount of time, which may result in the ability to obtain an evaluation of pore pressure and permeability at several points within a well using the mini-fall off technique as described in SPE 39407, previously incorporated herein by reference herein.

Tests may be conducted in the primary reservoir section, as there may be little value in obtaining permeability from barrier zones that might typically have lower permeabilities. Also, these low permeabilities may cause excessive time requirements in order to obtain the pseudo radial flow required to do the mini falloff analysis. The area between the packers may be minimized to reduce the effect of additional flow into the fracture during closure. Finally, a single injection may be performed at each station of interest since multiple injections may result in the masking of the pressure transient profile required. If additional injections are performed, this may be considered in the evaluation.

Various confirmations may be performed to reduce or prevent error. In some cases, further analysis and/or testing may be used to confirm that the tests properly characterize the parameters in certain situations, such as in cases involving multiple closures and/or shales. For example, the closure point may be confirmed to prevent false interpretation of early closure events as being representative of the minimum stress, and this misinterpretation may further lead to false assumptions of fluid efficiency and thus relative permeability. For example, if a test determining closure pressure may be based on a very early closure event, the results may translate to a fluid efficiency of about 30%. These low values of efficiency may improperly indicate a low permeability rock, rather than a permeability for shales having efficiencies of more than about 80%.

Additional guidelines may be provided to address potential differences that may occur in certain applications or under certain conditions. For example, additional guidelines may be used to both perform and analyze mini break downs. Additional guidelines may also address test time. When obtaining measurements from an injection test performed by a wireline conveyed tool, the test time may be limited to a given period. Time limits may be set at a given time frame, for example, to prevent stuck tools in the wellbore. In another example, testing may be performed to determine if there is a high probability of additional closure events that are yet to be seen, while minimizing excessive pressure monitoring time.

Additional guidelines may also be provided for geological parameters. In some cases, geological parameters may affect test results. Some geological testing may be used to evaluate how certain geological formations, such as shale, affect geological parameters, such as thermal maturity, mineralogy, organic richness and adjacent formations such as those bearing water. These parameters may be obtained using conventional techniques, such as wireline logging.

Additional guidelines may also be provided for material property parameters, such as pore pressure and permeability. In some cases, certain parameters, such as permeability and pore pressure, may behave differently in certain conditions, such as in shale. Permeability may be obtained using conventional core testing. The existence of natural fractures may contribute to overall system permeability, stress magnitude, and the ability to contain a fracture.

In some cases, such as shale or other conditions, permeability may be measured using a number of different techniques using core samples. Based on these core samples, a porosity permeability relationship may be established that can then be used to establish a rough guideline for permeability along the wellbore. In some cases, it may be impractical to obtain a core. If extraction of a core is possible, during extraction, the properties of the core may be altered or the core may be damaged. The core may be brought out of its in-situ environment, taken to a lab where the in-situ environment is, at which point tests are run. Along with certain uncertainty, measurements of the core may provide the matrix permeability, but may not take into account the effect of natural fractures or other secondary porosity which may result in an overall system permeability that is greater than the matrix permeability.

Guidelines may also be provided for the existence of natural fractures. There are several ways to determine the existence of these fractures, such as using 3d seismic tools, that can pick up fractures using techniques such as ant tracking or even seismic inversion. Engineers may also use traditional logging techniques such as image logs to detect fractures or sonic measurements to infer the existence of fractures. These techniques may be used to confirm or deny the existence of fractures and, in some cases, resolve the effectiveness of those fractures. Further evaluation may be needed in order to determine whether the fractures are open and producing, or not, or whether they are interconnected. The ability to evaluate the natural fractures and their potential uncertainties may affect values of system permeability.

With respect to pore pressure, the formation pore pressure may be used in determining gas in place, and for calibrating stress and production models. Pore pressure may be difficult to obtain in cases involving very low permeability and porosity, such as some shale wells. Well testing and fracture injection tests may be used to generate estimates of pore pressures. However, extensive shut in times may be needed in order to obtain values of pore pressure.

Guidelines may also be provided for stress measurements and fracture containment. These parameters may be generated using sonic logging. Using continuous measurements of shear and compressional travel times, an estimation of Poisson's ratio can be calculated. With this data, and adjusting for pore pressure and tectonics, an estimation of in-situ stresses may be made. This estimation may be provided by using, for example, measurements of Stoneley waves or other sonic measurement to account for anisotropy caused by the thin bedding in shales. In such cases, a number of assumptions may be made in order to calculate stress; namely tectonics and pore pressure which may not be known for certain in a given well. Thus, for accurate stress magnitudes from sonic logs, the logs may be calibrated by one or more direct measurements.

In-situ stress measurements may be obtained through micro fracturing tests performed, for example, using the wireline stimulation tool(s) of FIGS. 1.1-1.3. In a given example, tests may be performed to obtain measured values of closure pressures, as well as fracture azimuth, to further refine their hydraulic fracture models in shale reservoirs. Stress in the wellbore may dictate how fractures will initiate and propagate away from the wellbore. Thus, an understanding of the stresses may be used to determine the viability of a new play, as well as optimizing completions in the early development phase of a field. Other main parameters, such as permeability, pore pressure and the existence of secondary porosity, may also be obtained using this wireline stimulation tester.

One way to obtain the properties of permeability, pore pressure and stress, is through injection/fall off testing using the procedure outlined in SPE 139067, previously incorporated herein, in which a volume of fluid (e.g., from about 10 to about 30 bbls) is injected into the toe stage of a horizontal well prior to fracturing. The pressure may be monitored and analysis of the decline made using G-function analysis (see, e.g., SPE 107877 previously incorporated herein), and after closure analysis methods that ultimately result in obtaining the state of horizontal stresses at that toe stage, reservoir pressure and an estimate of permeability. This may be used to gather additional data during the time that a well may be idle.

Pressure may be monitored from the surface, and the effect of wellbore storage and uncertainties in hydrostatic head and any added value of error to the bottom hole pressure measurements may be calculated. Potential uncertainty in fracture height as well as determination of volume that is injected into the formation may also be addressed. Using mini-fall off analysis as described in SPE 38676, previously incorporated herein, values of transmissibility ($kh/\mu$) may be obtained from this analysis. An estimate of reservoir fluid viscosity ($\mu$) may also be obtained. However, further analysis may be needed to obtain fracture height.

In some cases, adjustment may be made to address potential error or to adjust to certain applications which may involve limited fracture height. For example, unlike conventional reservoirs, certain formations, such as shales, may contain many laminated layers of varying mineralogy. In such cases, the vertical permeability may be assumed to be negligible and the portion of the reservoir that is contacted by the fracture may be taken into account. That is, the maximum height that may be used to determine k is the fracture height obtained during pumping. This can be obtained, for example, by two methods in a horizontal wellbore.

First, some form of microseismic fracturing monitoring which can give a direct measurement of where the rock has failed (which may correlate to fracture height) may be used. In some cases, for example, where this may not be a practical solution, is too expensive a procedure, or may contain some uncertainty where such a small volume is injected which may result in poor characterization of the fracture, a second method may be needed. The second method that can be used is a fracture model for predicting the height of the fracture obtained. This may involve an understanding of the formation mechanical properties across the stratigraphic sections of the reservoir at the point where fracture initiation occurs. Where this may not be accurately obtained, for example in some horizontal wellbores, offset data may be used.

In another example, adjustments may be made for the presence of pinch points. Even though a fracture may open up across several zones, differences in horizontal stresses as well as differences in permeability may cause certain sections of the fracture to close before other sections, which may isolate the pressure transient that may be measured to an area significantly smaller than the area contacted by the fracture. In addition, it may not be possible to accurately model the height of the reservoir section that is communicating the pressure transient and the amount of fluid that was injected into that section of the reservoir which may affect model results. These and other conditions may be considered in the evaluations.

Stimulation Operations

FIG. 6 depicts a method 600 of performing a stimulation operation. The method may be performed using the wireline stimulation tools 100.1, 100.2, 100.3 as previously described. The method involves 672—perforating the interval, 674—deploying a wireline stimulation tool into the wellbore, 676—isolating an interval of the wellbore, 678—injecting fluid into the interval, 680—collecting pressure measurements during injection into the interval, 682—controlling pressure of fluid in the interval, 684—imaging fractures of the formation, 685—obtaining a core sample, 686—generating a fracture closure based on the pressure measurements, 687—generating transmissibility based on the fracture closure and a mini fall off test, 688 generating system permeability from the transmissibility and the fracture geometry, 690—comparing measured downhole parameters, and 692—repeating the method at one or more locations.

Generating downhole parameters may involve performing a fall off test, performing a mini stress test, generating instantaneous shut in pressure, and generating closure pressure. Generating the fracture parameters may involve generating transmissibility and generating fracture spacing. The guidelines herein may also be used in generating these items.

The development of any actual embodiment, numerous implementation—specific decisions may be made to achieve the developer's specific goals, such as compliance with system related and business related constraints, which may vary from one implementation to another. Moreover, it will be appreciated that such a development effort may be complex and time consuming but may nevertheless be a routine undertaking for those of ordinary skill in the art having benefit of this disclosure.

The description and examples are presented solely for the purpose of illustrating the preferred embodiments of the invention and should not be construed as a limitation to the scope and applicability of the invention. While the compositions of the present invention are described herein as comprising certain materials, it should be understood that the composition may optionally comprise two or more chemically different materials. In addition, the composition may also comprise some components other than the ones already cited. In the summary of the invention and this detailed description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific points, it is to be understood that inventors appreciate and understand that any and all data points within the range are to be considered to have been specified, and that inventors possess of the entire range and all points within the range.

Although only a few example embodiments have been described in detail above, those skilled in the art will readily appreciate that many modifications are possible in the example embodiments without materially departing from the system and method for performing wellbore stimulation operations. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

We claim:

1. A method of performing a stimulation operation for a subterranean formation penetrated by a wellbore, the method comprising:

collecting pressure measurements of an isolated interval of the wellbore during injection of an injection fluid therein;

performing a mini fall off test of the isolated interval during the injection;

determining a fracture closure value based on the collected pressure measurements;

determining a transmissibility value based on the fracture closure and a result of the mini fall off test;

determining fracture geometry by imaging, while the interval is isolated, the subterranean formation about the isolated interval and measuring fracture geometry of fractures in images generated therefrom; and determining a system permeability value from the transmissibility value and the determined fracture geometry.

2. The method of claim 1, wherein collecting comprises generating a pressure curve from the pressure measurements and generating an injection pressure, a breakdown pressure, an instantaneous shut in pressure and a closure pressure therefrom.

3. The method of claim 2, wherein determining fracture geometry comprises taking core samples from the subterranean formation.

4. The method of claim 2, further comprising determining fracture dimensions based on the system permeability and the matrix permeability.

5. The method of claim 1, wherein determining fracture closure comprises performing a mini stress test based on the pressure measurements.

6. The method of claim 5, wherein determining fracture closure comprises generating a G-function derivative curve and determining a deviation point from a slope of an incline of the G-function derivative curve.

7. The method of claim 1, wherein determining fracture geometry comprises obtaining a core sample of the subterranean formation and generating a matrix permeability therefrom.

8. The method of claim 1, wherein determining transmissibility comprises generating a flow regime identification plot of radial and linear flow from the pressure measurements and determining a slope of a vertical portion of the radial and the linear curves of the flow regime identification plot.

9. The method of claim 1, further comprising determining fracture dimensions based on the system permeability and a matrix permeability.

10. The method of claim 1, further comprising perforating a wall of the wellbore.

11. The method of claim 1, further comprising deploying a wireline stimulation tool into the wellbore and defining the isolated interval of the wellbore by expanding at least one packer of the wireline stimulation tool about a portion of the wellbore.

12. The method of claim 11, wherein an injection volume of the fluid injected into the isolated interval is between 100 and 400 ml.

13. The method of claim 1, further comprising injecting fluid into the isolated interval.

14. The method of claim 1, further comprising controlling pressure in the isolated interval.

15. The method of claim 1, wherein collecting pressure measurements comprises measuring pressure in the isolated interval with at least one pressure gauge.

16. The method of claim 1, further comprising performing sonic logging.

17. The method of claim 1, further comprising repeating the method at the isolated interval.

18. The method of claim 1, further comprising repeating the method for another isolated interval.

19. A method of performing a stimulation operation for a subterranean formation penetrated by a wellbore, the method comprising:

deploying a wireline stimulation tool into the wellbore;

isolating an interval of the wellbore by expanding at least one packer of the wireline stimulation tool about a portion of the wellbore;

injecting fluid into the isolated interval of the wellbore with the wireline stimulation tool;

taking pressure measurements in the interval with the wireline stimulation tool;

performing a mini fall off test of the interval while injecting fluid into the interval;

determining a fracture closure value based on the pressure measurements;

determining a transmissibility value based on the fracture closure and a result of the mini fall off test;

estimating a fracture geometry value;

imaging the subterranean formation about the isolated interval while the interval is isolated and verifying the estimated fracture geometry value from images generated therefrom; and determining system permeability from the transmissibility and the fracture geometry.

20. The method of claim 19, further comprising perforating a wall of the wellbore.

21. The method of claim 19, wherein verifying the fracture geometry comprises taking a core sample from the subterranean formation.

22. The method of claim 19, further comprising moving the wireline stimulation tool to another location and repeating the method.

23. The method of claim 19, wherein isolating comprises isolating the interval of the wellbore with dual packers on the wireline stimulation tool.

24. A method of performing a stimulation operation for a subterranean formation penetrated by a wellbore, the method comprising:

deploying a wireline stimulation tool into the wellbore;

isolating an interval of the wellbore by expanding at least one packer of the wireline stimulation tool about a portion of the wellbore;

injecting fluid into the isolated interval of the wellbore with the wireline stimulation tool;

taking pressure measurements in the interval with the wireline stimulation tool;

determining a fracture closure value based on the pressure measurements;

determining a transmissibility value based on the fracture closure and a mini fall off test of the isolated interval during the injection;

estimating a fracture geometry;

imaging, with the wireline stimulation tool, the subterranean formation about the interval and verifying the fracture geometry from images generated therefrom;

sampling a core sample from the subterranean formation and generating a matrix permeability therefrom;

determining a system permeability value from the transmissibility value; and determining fracture dimensions based on the system permeability value and the matrix permeability value.

* * * * *